US006408774B1

(12) United States Patent
Meade

(10) Patent No.: US 6,408,774 B1
(45) Date of Patent: Jun. 25, 2002

(54) METHOD OF PRODUCING A TUFTED ARTICLE OR PRODUCT

(75) Inventor: Warren J. Meade, Christchurch (NZ)

(73) Assignee: Groz-Beckert KG (DE)

( * ) Notice: Subject to any disclaimer, the term of this patent is extended or adjusted under 35 U.S.C. 154(b) by 0 days.

(21) Appl. No.: 09/485,633

(22) PCT Filed: Aug. 12, 1998

(86) PCT No.: PCT/EP98/05133

§ 371 (c)(1),
(2), (4) Date: Jun. 1, 2000

(87) PCT Pub. No.: WO99/09241

PCT Pub. Date: Feb. 25, 1999

(51) Int. Cl.[7] ..... D05C 15/14
(52) U.S. Cl. ..... 112/80.32; 112/80.71
(58) Field of Search ..... 112/80.32, 80.71, 112/80.01, 80.15, 80.3, 80.45, 80.55, 80.57, 80.7, 80.72, 475.04, 475.17

(56) References Cited

U.S. PATENT DOCUMENTS 1,607,568 A * 11/1926 Shipway ..... 112/80.71 X
2,979,803 A * 4/1961 Keen
2,983,028 A * 5/1961 Cole
3,756,178 A * 9/1973 Forstmann
5,357,886 A * 10/1994 Piller

FOREIGN PATENT DOCUMENTS

DE 1785451 * 2/1971
GB 821702 * 7/1956

* cited by examiner

*Primary Examiner*—Ismael Izaguirre
(74) *Attorney, Agent, or Firm*—John C Purdue; David C. Purdue

(57) ABSTRACT

A method of producing tufted products is disclosed. The method includes the steps of installing a second set of reed fingers (8) relative to a tufting machine, feeding a pair of backing sheets (7,9) to the tufting machine with the second set of reed fingers (8) positioned between the backing sheets (7,9); operating the tufting machine in a normal manner to form a face-to-face structure through the backing sheets; and cutting or dividing the face-to-face structure to form two separate tufted products. No additional or extra backing stitch is included in the face-to-face structure formed through the backing sheets. Also disclosed is the installation of an optional lower presser foot (5) which, if present, temporarily holds the yarn during needle retraction.

10 Claims, 3 Drawing Sheets

METHOD OF PRODUCING A TUFTED ARTICLE OR PRODUCT

BACKGROUND OF THE INVENTION

1. Field of the Invention

This invention relates to a method of producing tufted articles such as a carpet or blanket product.

2. Description of the Related Art

For many years tufted articles have been produced on machines utilizing a bank of needles which pierce a foundation or backing sheet to form loops or tufts of yarn through the surface of the backing sheet. Materials such as carpets can be produced on such machines at a generally lower cost and greater throughput than woven carpet produced on weaving looms.

Specially constructed Wilton weaving looms have been used to produce articles in a face-to-face configuration. In this process a double structure is woven and then split into two cut pile fabrics. An advantage of this type of construction is that production throughput is increased to nearly double that of standard looms. A further advantage is that the dead pile yarn (per unit area) woven into the backings of two patterned fabrics made on a face-to-face loom is lower than that of comparable fabrics woven on standard looms.

Examples of tufting machines for producing a double plush-like product such as a carpet and pile upholstery fabric are described in British Patent specification No. 821702 and U.S. Pat. No. 5,357,886. A disadvantage of the invention described in specification No. 821702 is that a locking stitch is required in order to lock the tufts to the backing sheet. The same disadvantage applies to the invention described in the U.S. specification and it also has a complicated needle support arrangement required to overcome the disadvantage mentioned in the prior German patent specification No. 1785451 B. The German specification requires the needles to be spaced apart to allow for separate grippers to be included for each row of needles. This results in a carpet with a large spacing between adjacent tufts.

An object of the present invention is to provide a method of producing tufted articles or products using a face-to-face technique to increase significantly production throughput and to offer a useful alternative choice in the production of carpet or blankets or other tufted products.

An object of the present invention is therefore to provide a tufting machine with a minimum of spacing between adjacent tufts without the need for the added complication of bulky mechanisms for the insertion of locking stitches in the backing sheet.

Another object of the invention is to reduce the dead yarn per unit area (as a percentage of total pile yarn weight) in the back of fabrics produced on double sliding needle bar and other patterned tufted fabrics.

SUMMARY OF THE INVENTION

According to a first aspect of the invention there is provided a method of producing tufted products including the steps of:

installing a second set of reed fingers relative to a tufting machine;

optionally installing lower presser foot;

feeding to the tufting machine a pair of backing sheets with the second set of reed fingers positioned between the backing sheets;

operating the tufting machine in normal manner to form through the backing sheets, a face-to-face structure without the inclusion of any backing stitch and in which the lower presser foot if included temporarily holds the yarn during needle retraction;

cutting or dividing the face-to-face structure to form two separate tufted products.

According to the second aspect of the invention there is provided a tufting machine adapted to produce either a cut pile and a loop pile tufted product or two cut pile products.

According to a third aspect of the invention there is provided a retrofit kit for a tufting machine including a second bank of reed fingers adapted to be positioned between a supply mechanism or mechanisms adapted to supply a pair of backing sheets and a cutting or slicing mechanism adapted to split a face-to-face structure produced by the modified tufting machine.

According to yet another aspect of the invention there is provided a tufted article or product produced according to the method or on the machine as hereinbefore defined.

Further aspects of the invention which should be considered in all its novel aspects will become apparent from the following description which is given by way of example only.

Examples of the invention will now be described with reference to the accompanying drawings in which:

DESCRIPTION OF THE PREFERRED EMBODIMENTS

Figure 1:
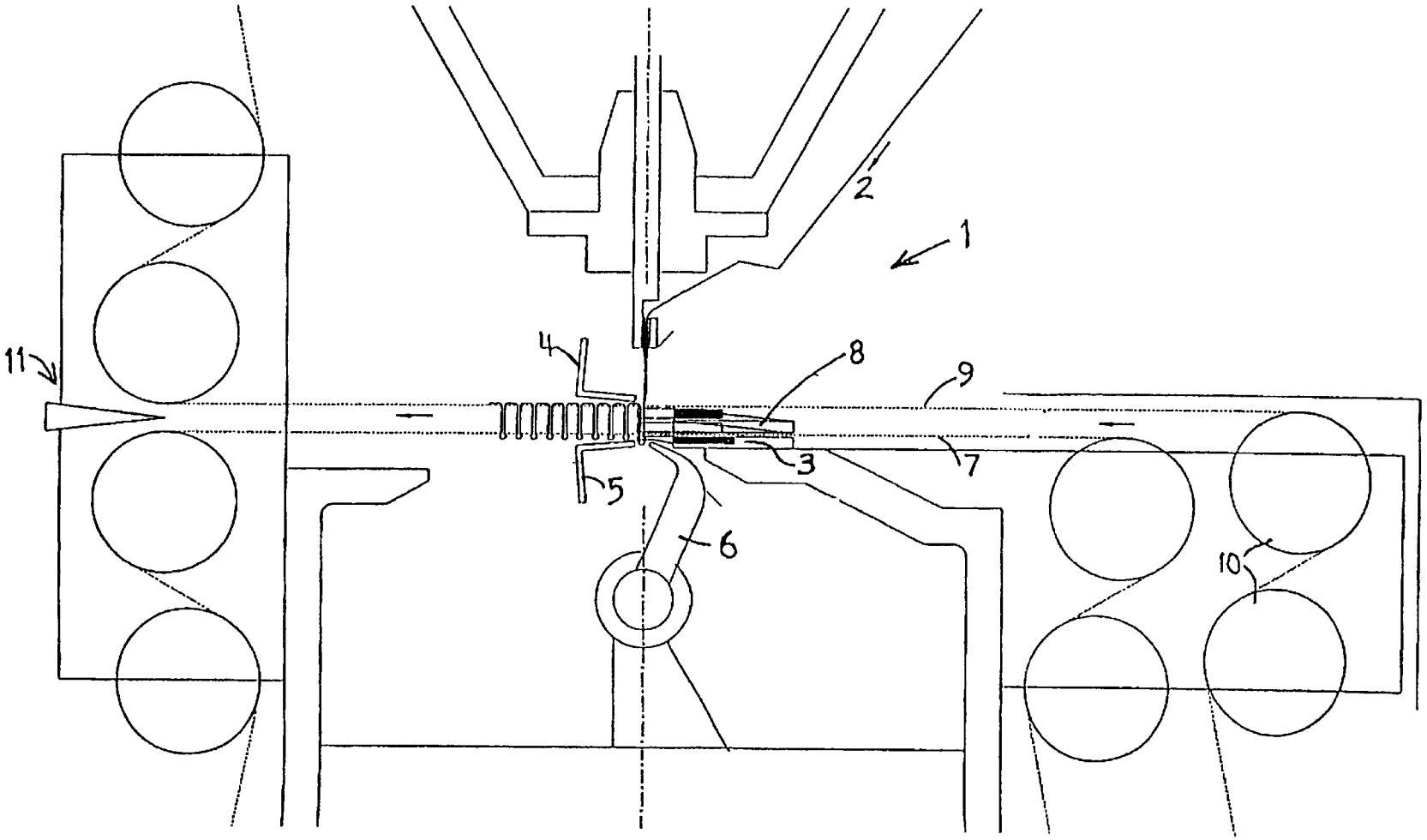
FIG. 1 shows diagrammatically a vertical section through a basic configuration of tufting machine adapted to produce tufted products according to the present invention.
Figure 2:
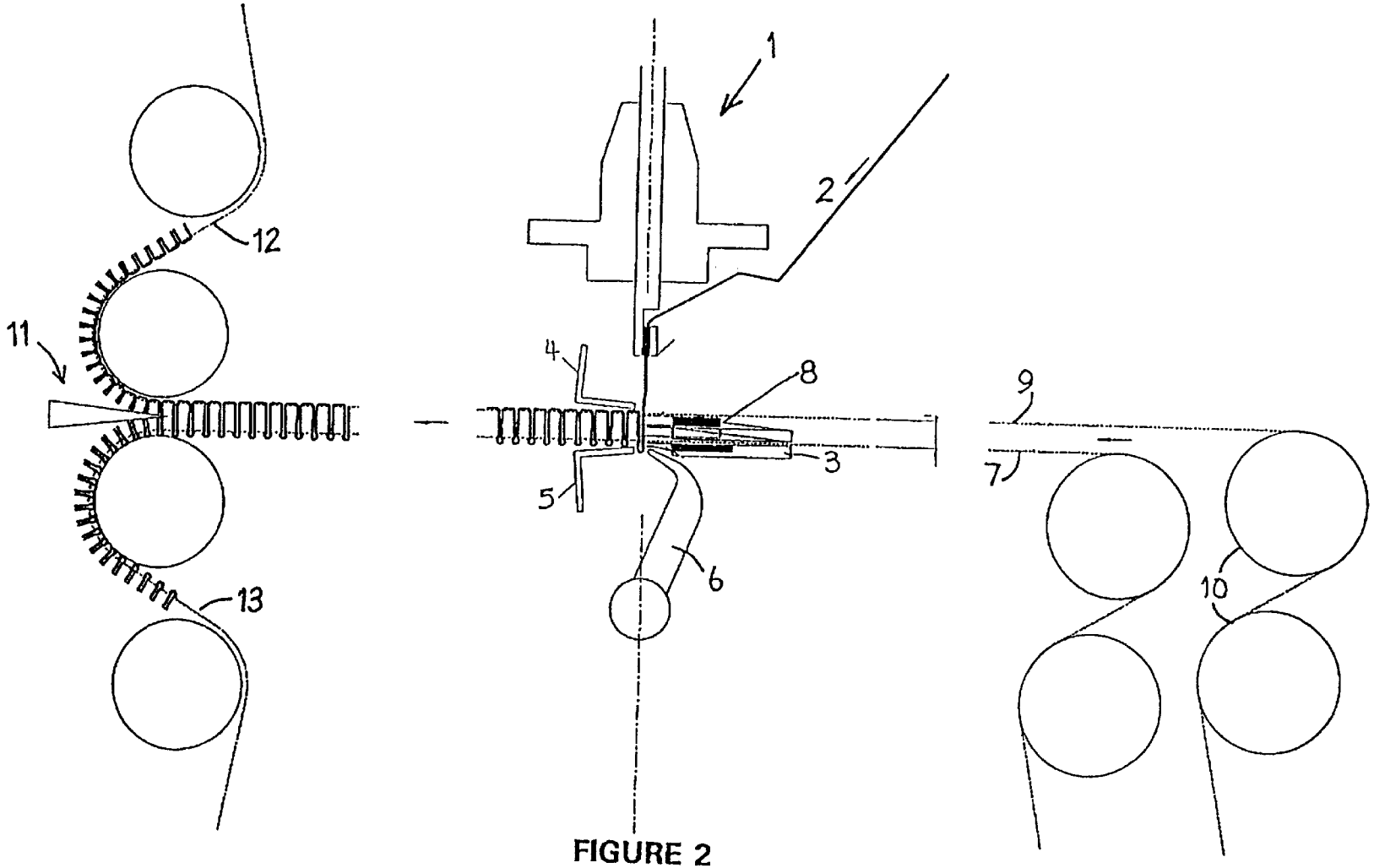
FIG. 2 shows a section similar to that shown in FIG. 1 and adapted for producing two cut pile tufted products.
Figure 3:
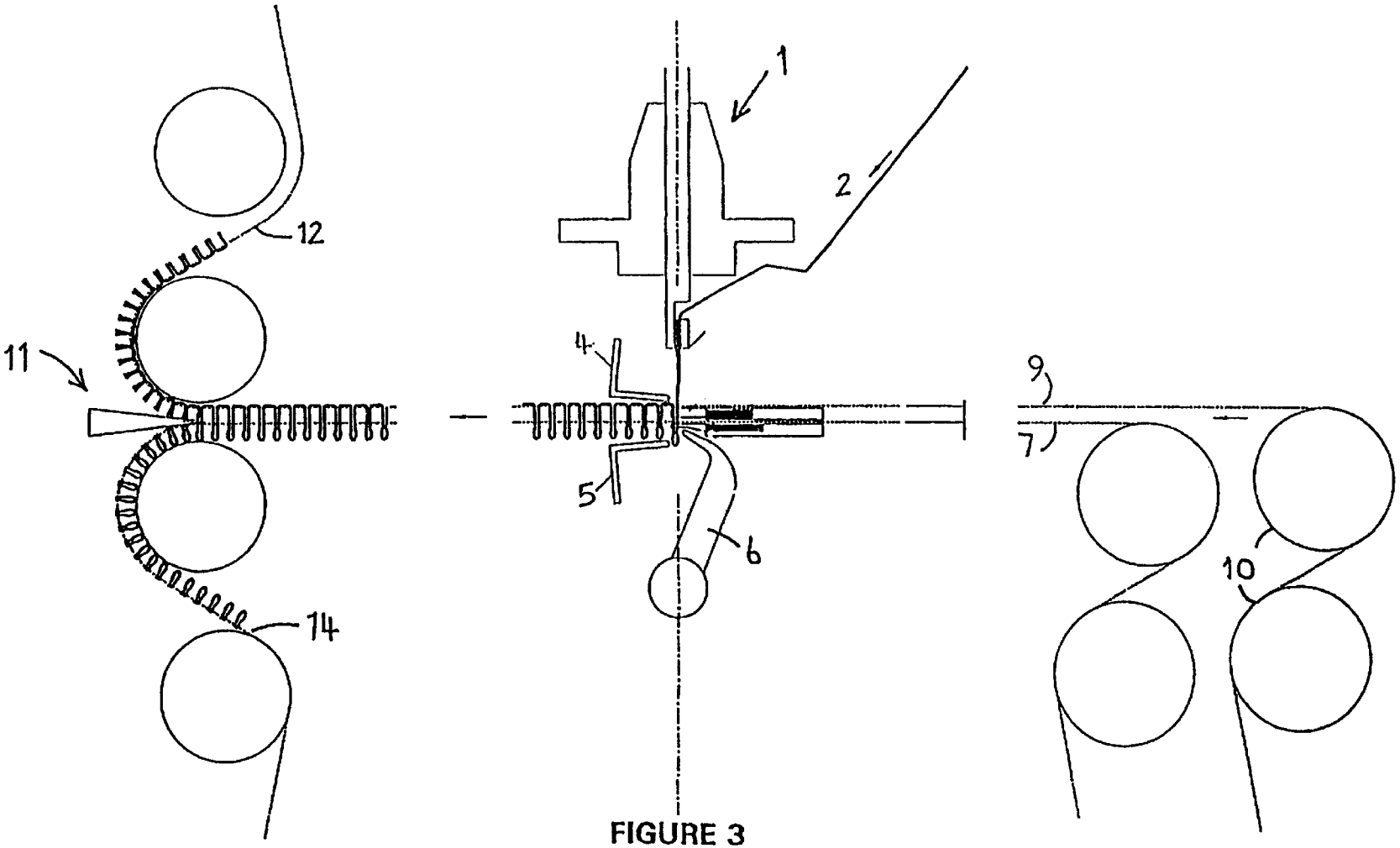
FIG. 3 shows a section similar to that shown in FIG. 2 and modified to produce in a single operation both a cut pile and loop pile product.

A standard tufting machine (not shown) incorporates yarn or fiber stream feed mechanisms from a creel or beam adapted to feed yarns to an elongated needle block in which a series of needles are mounted. The needles reciprocate vertically between spaced reed fingers over which a backing sheet of fabric passes.

Existing tufting machines include a presser foot adapted to assist formation of loops or cut loops when a needle is raised. A looper is also included to retain loops formed in the tufting process.

It is envisaged that the present invention can be provided for incorporation into new constructions of tufting machine or as a retrofit kit for existing tufting machinery because of its simplified form without the need for a locking stitch mechanism and is associated yarn feed mechanism.

The present invention is also suitable for incorporation into new constructions of machinery for patterned tufted fabrics (e.g. double sliding needlebar machinery) and as a retrofit kit for the same.

What is claimed is:

1. A method of producing tufted products with a tufting machine on which a second set of reed fingers (8) and, optionally, a lower presser foot (5) has/have been installed, said method including the steps of feeding to the tufting machine a pair of backing sheets (7,9) with the second set of reed fingers (8) positioned between the backing sheets (7,9);

operating the tufting machine in normal manner to form through the backing sheets (7,9) a face-to-face structure without the inclusion of any additional/extra backing stitch and in which the lower presser foot (5) if included temporarily holds the yarn during needle retraction;

cutting or dividing the face-to-face structure to form two separate tufted products.

2. A method according to claim 1 wherein either a cut pile and a loop pile tufted product or two cut pile products are produced.

3. A method according to claim 1 or claim 2 wherein one or both of the backing sheets (7,9) incorporate(s) a bonding fiber or coating which which, after a heat or other treatment stage, improves the anchorage of the tufted pile yarns in the final product.

4. A method as claimed in claim 3 wherein the lower backing sheet (7) has a raised surface that interacts with the backing loop so as to resist extraction of the tuft and to improve the tuft anchorage of the pile yarn.

5. A method as claimed in claim 4 wherein a coating is applied to the backing sheet or sheets (7,9) in a subsequent processing stage.

6. A method as claimed in claim 1 wherein the lower backing sheet (7) has a raised surface that interacts with the backing loop so as to resist extraction of the tuft to improve the tuft anchorage of the pile yarn.

7. A method as claimed in claim 2 wherein the lower backing sheet (7) has a raised surface that interacts with the backing loop so as to resist extraction of the tuft to improve the tuft anchorage of the pile yarn.

8. A method as claimed in claim 1 wherein a coating is applied to the backing sheet or sheets (7,9) in a subsequent processing stage.

9. A method as claimed in claim 2 wherein a coating is applied to the backing sheet or sheets (7,9) in a subsequent processing stage.

10. A method as claimed in claim 3 wherein a coating is applied to the backing sheet or sheets (7,9) in a subsequent processing stage.

* * * * *